US008669474B2

(12) United States Patent
Battle et al.

(10) Patent No.: US 8,669,474 B2
(45) Date of Patent: Mar. 11, 2014

(54) POWER CABLE WITH HIGH TORSIONAL RESISTANCE

(75) Inventors: Josep Maria Battle, Barcelona (ES); Matias Campillo, Barcelona (ES); Valentina Ghinaglia, Barcelona (ES)

(73) Assignee: Prysmian Cables y Sistemas S.L., Barcelona (ES)

( * ) Notice: Subject to any disclaimer, the term of this patent is extended or adjusted under 35 U.S.C. 154(b) by 521 days.

(21) Appl. No.: 12/449,561

(22) PCT Filed: Feb. 23, 2007

(86) PCT No.: PCT/IB2007/000514
§ 371 (c)(1),
(2), (4) Date: Jan. 25, 2010

(87) PCT Pub. No.: WO2008/102197
PCT Pub. Date: Aug. 28, 2008

(65) Prior Publication Data

US 2010/0163274 A1 Jul. 1, 2010

(51) Int. Cl.
*H01B 7/00* (2006.01)

(52) U.S. Cl.
USPC ..... 174/113 R; 174/117 R

(58) Field of Classification Search
USPC ..... 174/36, 102 R, 106 R, 113 R, 116, 108
See application file for complete search history.

(56) References Cited

U.S. PATENT DOCUMENTS

| | | | | | |
|---|---|---|---|---|---|
| 2,286,827 | A * | 6/1942 | Morrison | 174/103 |
| 4,398,058 | A * | 8/1983 | Gerth et al. | 174/106 D |
| 5,834,699 | A * | 11/1998 | Buck et al. | 174/113 R |
| 6,288,339 | B1 | 9/2001 | Efraimsson et al. | |
| 6,903,277 | B2 * | 6/2005 | Whidden | 174/106 R |
| 7,166,802 | B2 * | 1/2007 | Cusson et al. | 174/113 R |
| 7,309,835 | B2 * | 12/2007 | Morrison et al. | 174/74 R |
| 2003/0168242 | A1 * | 9/2003 | Whidden | 174/113 R |

FOREIGN PATENT DOCUMENTS

| | | | | |
|---|---|---|---|---|
| DE | 33 26 987 | A1 | 2/1985 | |
| DE | 3326987 | A1 * | 2/1985 | H01B 7/04 |
| GB | 597957 | | 2/1948 | |
| GB | 2262835 | * | 6/1993 | H01B 7/00 |
| JP | 2005-122912 | | 5/2005 | |

* cited by examiner

*Primary Examiner* — William H Mayo, III
(74) *Attorney, Agent, or Firm* — Finnegan, Henderson, Farabow, Garrett & Dunner, L.L.P.

(57) ABSTRACT

A power cable includes at least two power conductors, at least one earth conductor, and a tubular outer jacket surrounding the power conductors and earth conductor. Each power conductor may comprise a conductive core and an insulating layer surrounding said conductive core. The power conductors may be twisted and contact each other. The earth conductor may have a diameter smaller than the power conductors and may be positioned in the interstitial area between two adjacent power conductors and the outer jacket. The earth conductor may contact the two power conductors along two respective contact lines and the outer jacket along an extrados portion facing outward with respect to the cable. The outer jacket may have substantially constant thickness. The lateral surfaces of the earth conductor may be free from constraints between the contact lines with the power conductors and the extrados contacted by the outer jacket.

6 Claims, 2 Drawing Sheets

POWER CABLE WITH HIGH TORSIONAL RESISTANCE

CROSS REFERENCE TO RELATED APPLICATION

This application is a national phase application based on PCT/IB2007/000514, filed Feb. 23, 2007, the content of which is incorporated herein by reference.

BACKGROUND OF THE INVENTION

1. Field of the Invention
2. Description of the Related Art

The present invention relates to a power cable, particularly a power cable for use in a wind mill power plant.

A wind mill comprises a tower and a nacelle on top thereof. The nacelle houses, inter alia, the generator system, the blades and the transformer. The nacelle is suitable for being pivoted (with respect to the tower axis) in order to follow the wind direction changes.

A power cable is positioned to run from the transformer (on the tower top) to the tower base (where the generated electrical power is conveyed to the distribution network or delivered directly to an end user), said cable being vertically positioned along the longitudinal development of the tower, inside thereof.

Typically, the power cable is a tripolar cable and generally comprises three insulated power conductors (each power conductor comprising: conductor+inner semiconductive layer+insulation+outer semiconductive layer) and three earth conductors, each earth conductor being positioned in the interstitial area formed between two adjacent power conductors. The three power conductors and the three earth conductors are helically twisted and the whole assembly is successively coated with a cable outer jacket.

The cable designs known in the art, which are suitable for being used in a wind mill, are typically provided with an outer jacket that penetrates into the interstitial areas present between the earth conductors and the cable power conductors (this is due to the fact that the outer jacket is pressure extruded over the power conductors/earth conductors assembly). Therefore, in the cable designs known in the art, the outer jacket has a thickness which is not constant in the cable cross-section, said thickness being remarkably greater in correspondence of the interstitial areas than at the cable power conductors extrados.

Due to the rotational movement of the nacelle both in the clockwise and in the counterclockwise directions, the power cable is subjected to cycles of alternate torsional stresses. Specifically, the torsional stresses arise in the cable length which is freely positioned within the tower, i.e. the cable length which exits from the transformer and is suspended within the tower before being fixed to the sidewall thereof (said cable length is of about 18-20 m, while the tower height is typically 60-100 m). Generally, a wind mill is operated to make 5 complete turns (360° each turn) in a given direction (e.g. clockwise) and then the rotation is inverted (5 turns in the opposite direction, e.g. counterclockwise). On an average, a wind mill makes one turn/day since the wind direction generally varies not more than 180° in 24 h.

When power cables according to the known art are employed, it may happen that the alternate torsional stresses cause a premature breakage of the earth conductors. Since the breakage of some wires of an earth conductor generally causes a significant variation in the electrical resistance of the earth conductor, the power cable requires to be substituted and the wind mill to be stopped for allowing extraordinary maintenance thereof.

SUMMARY OF THE INVENTION

It is an aim of the present invention to provide a power cable having enhanced resistance to torsional stresses during operation thereof (particularly, during operation in a wind mill power plant with conductor temperature of about 90° C.).

A further aim of the invention is to provide a cable having a longer service life, allowing the cable to keep functioning under normal working conditions for more than 20 years, which is the normal service life of a Wind Mill Plant.

A further aim of the invention is to provide a power cable having a compact structure with limited volume.

Another aim of the invention is to provide a power cable which has a simple structure and which is easy to manufacture.

In order to solve the above problem, in accordance with the invention, it is provided a power cable comprising at least two power conductors, at least one earth conductor and a tubular outer jacket surrounding power conductors and earth conductor, each power conductor comprising a conductive core and an insulating layer surrounding said conductive core, the power conductors being twisted contacting each other, the earth conductor having a diameter smaller than the power conductors and being positioned in an interstitial area defined between two adjacent power conductors and the outer jacket, the earth conductor contacting the two power conductors along two respective contact lines, characterized in that the outer jacket has substantially constant thickness and contacts the earth conductor along an extrados portion facing outwards with respect to the cable, the lateral surfaces of the earth conductor being free from constraints between said contact lines with the power conductors and said extrados contacted by the outer jacket.

BRIEF DESCRIPTION OF THE DRAWINGS

For better explaining the innovative principles of the present invention and the advantages it offers over the known art, a possible embodiment applying said principles will be described hereinafter by way of example, with the aid of the accompanying drawings. In the drawings.

DETAILED DESCRIPTION OF THE INVENTION

Figure 1:
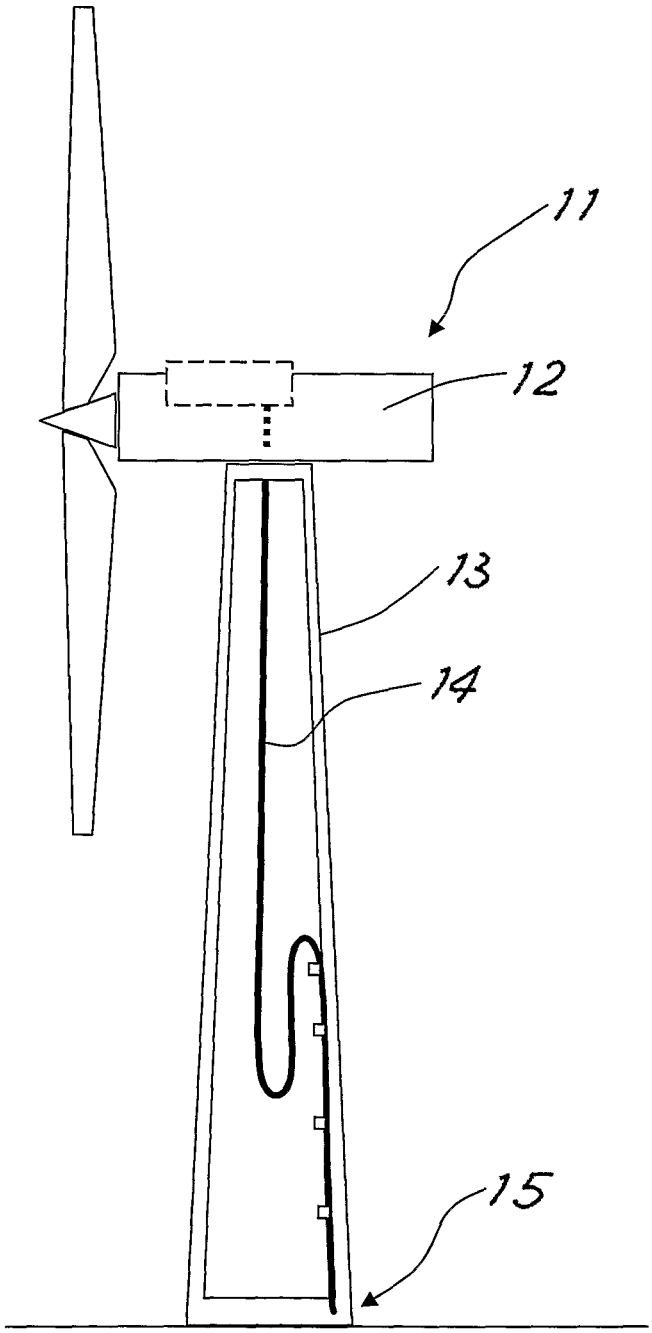
FIG. 1 shows a wind mill for power generation comprising a cable according to the present invention.

With reference to the drawings, FIG. 1 shows a wind mill 11 for electric power generation. The wind mill 11 comprises a nacelle 12 mounted on top of a tower 13. The nacelle is pivotally mounted on the tower in order to follow the wind direction changes. The nacelle 12 houses, inter alia, the generator system, the blades and the transformer.

A power cable 14 is positioned to run from the transformer (housed in the nacelle 12) to the tower base 15 (where the generated electrical power is conveyed to the distribution network or delivered directly to an end user), said cable being vertically suspended along the longitudinal development of the tower 13, inside thereof.

Figure 2:
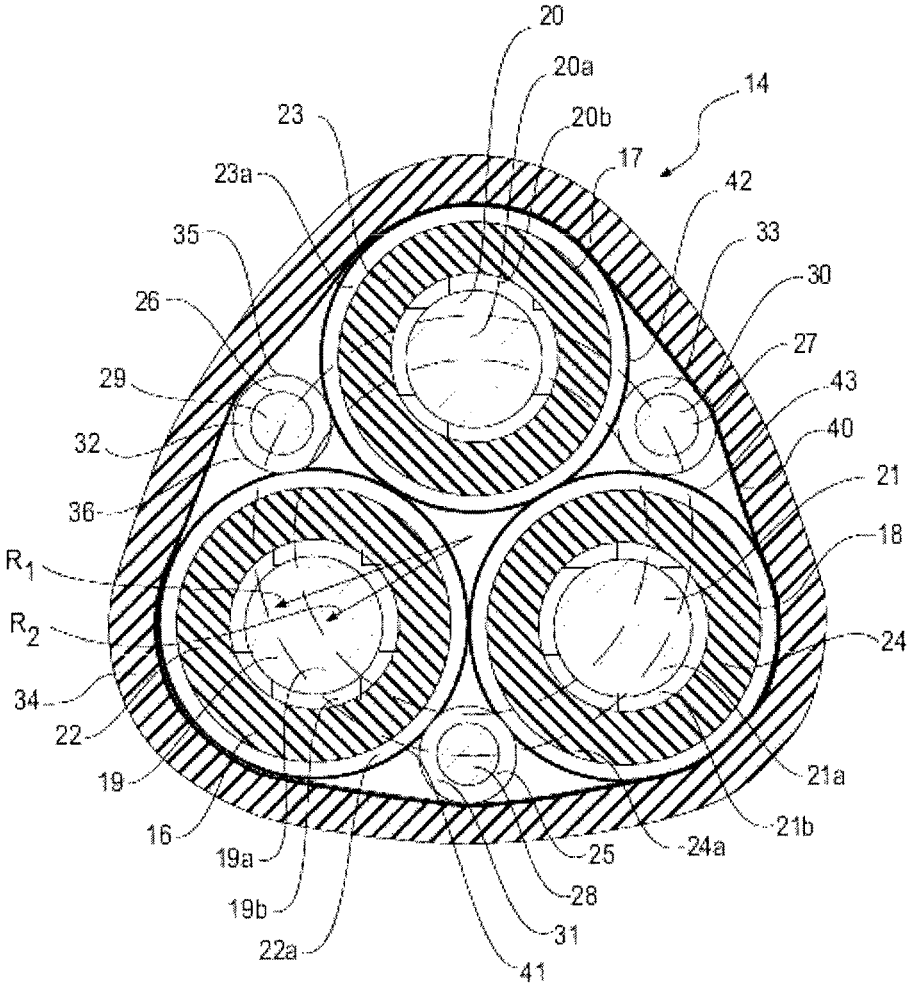
FIG. 2 shows a cross section of a cable according to the invention.

FIG. 2 shows a cross section of power cable 14 which, according to an embodiment of the invention, is a 3-phase cable comprising three power conductors 16-18.

Each power conductor 16-18 comprises an inner conductive core 19-21 surrounded by an insulation layer 22-24. Advantageously, as shown in FIG. 2, the inner conductive cores 19-21 comprise a metallic conductor 19*a*-21*a*, covered by an inner semi-conductive layer 19*b*-21*b*. An outer semi-conductive layer 22*a*-24*a* surrounds the insulation layer 22-24.

The power conductors 16-18 are helically twisted along the cable, contacting each other tangentially.

According to FIG. 2, the power conductors 16-18 define a central interstice and three outer interstitial areas; each of the outer interstitial areas receives an earth conductor 25-27, having a diameter smaller than the power conductors 16-18.

Each earth conductor 25-27 can comprise an inner conductive core 28-30 surrounded by a semi-conductive outer layer 31-33.

As shown in FIG. 2, according to an embodiment of the invention, the axis of the earth conductors 25-27 lie on a helical profile having radius $R_1$ different from the radius $R_2$ of the helical profile defined by the axis of the power conductors 16-18. The radius $R_1$ corresponds to the radius of the primitive cylinder on which the helix lies, i.e. $R_1$ corresponds to the winding radius of the axis of the conductor (of the earth conductors 25-27) wound along the helix. The same applies to radius $R_2$ with respect to the power conductors of the inner conductive cores 19-21. Particularly, the radius $R_1$ of the helical profile defined by the earth conductors axis is greater than the radius $R_2$ of the helical profile defined by the power conductors axis. The cable 14 comprises also an outer tubular jacket 34, which surrounds the power conductors 16-18 and the earth conductors 25-27.

Each earth conductor 25-27 remains positioned between two adjacent power conductors and the wall of the outer jacket 34, contacting the two correspondent power conductors along two respective contact lines. Each earth conductor 25-27 also contacts the outer jacket 34 along an extrados portion facing outwards with respect to the cable 14.

The outer jacket 34 is realized with a substantially constant thickness, so that the interstitial areas between the earth conductors 25-27 and the power conductors 16-18 remain free. Particularly, referring to earth conductor 26, the lateral surfaces 35, 36 thereof are free from constraints between the contact lines with the power conductors 16, 17 and the extrados contacted by the outer jacket 34. The same applies to the other earth conductors 25 and 27.

Advantageously, a semiconductive tape 40 can be helically wound around power conductors 16-18 and earth conductors 25-27, the semiconductive tape 40 favoring the electrical contact between the external grounded surfaces of the conductors. In this case, the outer jacket 34 contacts the extrados portions of the earth conductors 25-27 with the interposition of tape 40. The presence of tape 40 can favor the reciprocal movement between the conductors 16-18, 25-27 and the outer sheath 34.

Moreover, each power conductor 16-18 is preferably provided with a semiconductive tape 41-43, helically wound on the external surface of the outer semiconductive layers 22*a*-24*a*. This arrangement may favor the reciprocal movement between the power conductors 16-18 and the adjacent earth conductors 25-27 upon torsion of the cable 14.

The Applicant has observed that, especially when the cable power conductors (specifically the center—the neutral axis—of each cable power conductor) lie on a helix diameter which is different from the helix diameter on which lie the earth conductors (specifically the center—the neutral axis—of each earth conductor), a torsion on the cable can give rise to stresses of different amounts in the cable power conductors and in the earth conductors.

In the cable according to the known art, the outer jacket material is present in the interstitial areas between power conductors and earth conductors, covering the surfaces of the earth conductors which face the power conductors, thus "freezing" the reciprocal position of the cable power conductors and the earth conductors. As a consequence, the earth conductors are substantially prevented from any radial and/or circumferential movement during twisting of the cable due to the nacelle pivoting movement: this situation can cause axial stresses (deriving from the torsional stresses applied onto the cable due to the rotation of the nacelle) in the earth conductors which, after a given number of torsional cycles, can cause breakage of the earth conductors (or a reduction of their performance, e.g. because of the breakage of one or more wires thereof) due to tensile or compressive stresses.

According to the invention, the cable resistance to torsional stresses is increased by allowing the earth conductors to move in the radial and/or in the circumferential direction. The Applicant has found to provide the cable with an outer jacket whose material does not penetrate into the cable interstitial areas between power conductors and earth conductors, thus having the lateral surface of the earth conductors facing the power conductors free from constraints. This allows the earth conductors to move in the radial and/or circumferential directions with respect to the cable power conductors, since the force exerted by the outer jacket onto the earth conductors is sensibly reduced with respect to the cables known in the art wherein the outer jacket material penetrates into the interstitial areas.

During operation of the wind mill, a modification of the reciprocal position of the earth conductors with respect to the cable power conductors (inside the cable structure) allows for a favorable distribution of the stresses that are transferred to the cable (in particular to the earth conductors thereof) during the alternate torsional cycles which the cable undergoes in use. In fact, by allowing the earth conductors to modify their position with respect to the cable power conductors, the earth conductors can better withstand the torsional and axial stresses since dangerous stress concentrations (tensile or compressive stresses—depending on the twisting direction applied to the cable—are localized on limited areas of the earth conductors) can be suitably avoided, thereby advantageously increasing the cable service life.

The cable is provided with an outer jacket 34 having a substantially constant thickness. Preferably, the outer jacket is obtained by extrusion in the form of a tube.

Preferably, in a cross-section of the cable the outer jacket 34 has a substantially rectilinear profile between a power conductor 16-18 and the extrados of an adjacent earth conductor 25-27. In an embodiment of the invention, the profile of the outer jacket 34 is also substantially rectilinear between two adjacent power conductors 17-19, being tangent to the extrados of the interposed earth conductor 25-27 over a narrow longitudinal surface thereof. The technical data of an embodiment of a cable according to the invention are reported in the following table:

| Phases (or power conductors): 3 × 25 $mm^2$ | |
|---|---|
| Conductive core | copper; nominal diameter: 6.5 mm |
| Inner semiconductive layer | nominal thickness: 0.8 mm; obtained by extrusion |

-continued

| | |
|---|---|
| Insulation layer | nominal thickness: 5.0 mm; obtained by extrusion |
| Outer semiconductive layer | nominal thickness: 1.0 mm; obtained by extrusion |
| Semiconductive tape | nominal twisting pitch: 33.1 mm |
| | Earth conductors: 3 × 10 $mm^2$ |
| Conductive core | copper; nominal diameter: 4.3 mm |
| Semiconductive layer | nominal thickness: 1.2 mm; obtained by extrusion |
| | Assembly |
| Phases + earth conductors + Semiconductive tape | assembly nominal diameter: 46.4 mm; |
| Outer sheath | nominal thickness: 3.5 mm; external nominal diameter: 53.4 mm; obtained by tube extrusion; approximate total extruded section area: 680 $mm^2$ |

As indicated in the table, the assembly "earth conductors/power conductors" is wound by a semi-conductive tape 40. The resistance tests carried out on the cable according to the invention have showed surprisingly good results in response to torsional stresses.

The cable was tested with torsional cycles, each cycle comprising four turns in the clockwise direction, four turns in the counterclockwise direction to reach the neutral position, four turns in the counterclockwise direction and then four turns in the clockwise direction to reach again the neutral position.

In the test, four turns were applied to the cable (and not five as usually happens in the windmill operation) as the test was carried out on a cable length which was lower than the free cable length normally present in the windmill tower. Therefore, the four turns in the test corresponded to the real torsional stress which is applied to the cable in use when five turns are applied.

After 2500 torsional cycles (as described above), the cable did not show any sign of collapsing or breakage. The limit of 2500 cycles is considered to correspond to a service life of 25 years under normal operation conditions (typically, a wind mill plant has an average life of 20 years).

Carrying out the same resistance test on cables manufactured according to the know art with the outer sheath extruded so that the interstitial areas between power conductors and earth conductors are occupied by the outer sheath, a breakage of the cable was experienced after only 1250 torsional cycles. The cable according to the known art which was tested had the same conductors of the embodiment described above with the same dimensioning, the only difference being that the outer sheath penetrated in the interstitial areas between the power conductors and the earth conductors. Therefore, the total extruded section area of the prior art cable was of about 925 $mm^2$ (instead of 680 $mm^2$ for the cable of the invention) and the extruded interstitial area of the prior art cable was of about 245 $mm^2$ (instead of about zero for the cable of the invention).

The power cable of the present invention, which is especially meant for use in a wind mill power plant, has an enhanced resistance to torsional stresses with respect to a comparable cable of the prior art.

Furthermore, the service life of a cable according to the invention is considerably long and allows to reduce the chance of breakage due to mechanical stress thereof.

Moreover, thanks to the arrangement of the earth conductors in the interstices between adjacent twisted power conductors, the overall assembly of the power cable is extremely compact with a limited overall volume.

The above description of an embodiment applying the innovative principles of the present invention is taken by way of example only. For instance, the cable can comprise a different number of power conductors, e.g. a 2-phase cable with two power conductors can be considered.

The invention claimed is:

1. A power cable comprising at least two power conductors, at least one earth conductor and a tubular outer jacket surrounding the power conductors and earth conductor, a semiconductive tape helically wound around the power conductors and earth conductor, each power conductor comprising a conductive core and an insulating layer surrounding said conductive core, the power conductors being twisted and contacting each other, the earth conductor having a diameter smaller than the power conductors and being positioned in an interstitial area defined between two adjacent power conductors and the outer jacket, the earth conductor contacting the two power conductors along two respective contact lines, the outer jacket having substantially constant thickness and contacting the earth conductor along an extrados portion facing outward with respect to the cable, wherein the interstitial areas between the power conductors, the earth conductor, and the outer jacket are free from other structural or filling elements and the lateral surfaces of the earth conductor are free from constraints between said contact lines with the power conductors and said extrados contacted by the outer jacket, and wherein the outer jacket is obtained by extrusion in the form of a tube and the outer jacket has a substantially rectilinear profile between a power conductor and the extrados of an adjacent earth conductor.

2. The power cable according to claim 1, comprising three power conductors.

3. The power cable according to claim 1, comprising an earth conductor in each interstitial area between two adjacent power conductors and the outer jacket.

4. The power cable according to claim 1, wherein an axis of the earth conductor defines a helix having a radius different from a radius of a helix defined by an axis of the power conductors.

5. The power cable according to claim 1, wherein, in a cross-section of the cable, the outer jacket has a substantially rectilinear profile between two adjacent power conductors, and is tangent to the extrados of the interposed earth conductor over a narrow longitudinal surface thereof.

6. The power cable according to claim 1, comprising three earth conductors.

* * * * *